US005590772A

United States Patent [19]

Schuhlen et al.

[11] Patent Number: 5,590,772

[45] Date of Patent: Jan. 7, 1997

[54] GOLF CLUB LOCK

[76] Inventors: Kevin Schuhlen, 14 Meadow Rd., East Longmeadow, Mass. 01028; Matthew J. DeNucci, 52 Trinity Ave., Glastonbury, Conn. 06033

[21] Appl. No.: 356,511

[22] Filed: Dec. 15, 1994

[51] Int. Cl.[6] ..... A63B 55/00

[52] U.S. Cl. ..... 206/315.3; 70/54

[58] Field of Search ..... 206/315.3, 315.6; 70/54, 55, 56, 58, 59, 64, 200, 19

[56] References Cited

U.S. PATENT DOCUMENTS

| | | | |
|---|---|---|---|
| 1,355,387 | 10/1920 | Cohen | 70/53 |
| 4,538,728 | 9/1985 | Lewis | 206/315.3 |
| 4,718,259 | 1/1988 | Appelbaum | 70/54 X |
| 4,831,849 | 5/1989 | Kortenbrede | 70/54 X |
| 4,863,019 | 9/1989 | Lewis et al. | 206/315.3 |
| 4,905,486 | 3/1990 | Appelbaum | 70/54 |
| 4,955,472 | 9/1990 | Yamazoe | 206/315.3 X |
| 5,004,100 | 4/1991 | Smith | 206/315.3 X |

*Primary Examiner*—Allan N. Shoap
*Assistant Examiner*—Christopher J. McDonald
*Attorney, Agent, or Firm*—McCormick, Paulding & Huber

[57] ABSTRACT

A locking device is provided which releasably secures a plurality of golf clubs therein. Each golf club has a head disposed at an end of a shaft which has a narrow region near the head and a wider region further from the head. The locking device comprises a plurality of elongated shackles each having parallel limbs extending from a bight portion and which are separated from one another by a distance greater than a club's narrow region and less than a club's wider region. The limbs of each shackle are lockingly receivable by a receiver to secure a plurality of club shafts therein. A lightweight polymeric retainer retains the receivers in slidably spaced relation therein, whereby the receivers, as well as said shackles, when lockingly received therein, may be aligned with individual compartments of a golf bag.

16 Claims, 3 Drawing Sheets

GOLF CLUB LOCK

FIELD OF THE INVENTION

This invention relates to golf clubs and more particularly to a device for locking a set of clubs to one another to protect them from theft while left unattended.

BACKGROUND OF THE INVENTION

Theft of golf clubs from unattended golf bags at public golf courses or country clubs has unfortunately been a common occurrence through the years. Various devices have been designed to secure golf clubs to one another and/or prevent the removal of clubs from golf bags.

One such device is disclosed in U.S. Pat. No. 5,004,100 and describes a metallic plate which is designed to fit over the open end of a golf bag. The plate has three slots which are closed at one end and open at the other and which are slightly wider than a narrow neck portion of the golf club shafts and substantially longer than its width, so that a group of golf clubs can be laterally inserted therein. A U-shaped arm is pivotally attached to the flat plate to close the "open" end of the slots and which can be locked in place to prevent removal of the clubs. Although when employed, this device may be effective in preventing golf club theft, it has several disadvantages. In particular, the device is relatively heavy and thereby tends to discourage golfers who prefer to tote their own bags as they play from carrying the lock around with them. Another drawback of such a device is that the spacing between partitions of various golf bags is not necessarily consistent from one bag to another. Since the distance between slots in the plate is not adjustable, the locking device will not adapt readily to various size bags. Therefore, specific locks must be matched to an individual bag and in the event a golfer changes bags or owns more than one bag, such as a full size bag for carrying on a golf cart and a "walking bag" for walking the course, a golfer would most likely be required to purchase more than one lock. A further disadvantage of such a device is that it is relatively costly.

Another locking device which may offer advantages in terms of being light weight and relatively inexpensive to manufacture, is disclosed in U.S. Pat. No. 2,738,113. This device discloses a Combination Club Carrier and Lock which comprises a pair of padlocks, each of which have U-shaped shackles that engage the shaft of a golf club. Each of the shackles is slightly wider than a narrow region of the club shaft and is substantially longer than its width, so that several golf clubs can be laterally inserted therein. The padlocks are interconnected to one another by a handle portion having eyes which each engage the shackle portion of one of the padlocks.

A disadvantage of this device is that it is not adaptable for use in conjunction with a golf bag and therefore would require removal of one's clubs from the bag before use. Another disadvantage is that the device cannot readily secure an entire set of clubs, unless more than one such locking device were used. A further drawback is that the device would be cumbersome to use, especially if one were using more than one lock in an attempt to secure a large number of clubs.

It is a principal object of this invention to provide an improved locking device for golf clubs.

It is an additional object of this invention to provide a lightweight golf club locking device.

A further object of this invention is to provide a golf club locking device of relatively simple and inexpensive construction that is relatively simple to use.

Another object of this invention is to provide a golf club locking device adapted to secure an entire set of clubs while they are disposed within a golf bag.

A further object of this invention is to provide a golf club locking device adapted to secure a golf bag as well as the clubs disposed therein.

Another object of the present invention is to provide a universal golf club locking device which is adjustable to fit a wide range of golf bags.

According to this invention, a locking device releasably secures a plurality of golf clubs therein, each golf club having a head disposed at an end of a shaft, the shaft having a narrow neck near the head and a wider region further from the head. The device comprises a plurality of elongated shackles each having generally parallel limbs extending from a bight portion and being separated from one another by a distance greater than a single club's narrow region and less than a single club's wider region. The limbs of each shackle are lockingly received by a receiver to secure club shafts therein and a retainer slidably retains said receivers.

The above and other objects and advantages of this invention will be more readily apparent from a reading of the following description of an exemplary embodiment thereof taken in conjunction with the following drawing.

DETAILED DESCRIPTION OF THE PREFERRED EMBODIMENT

Figure 1:
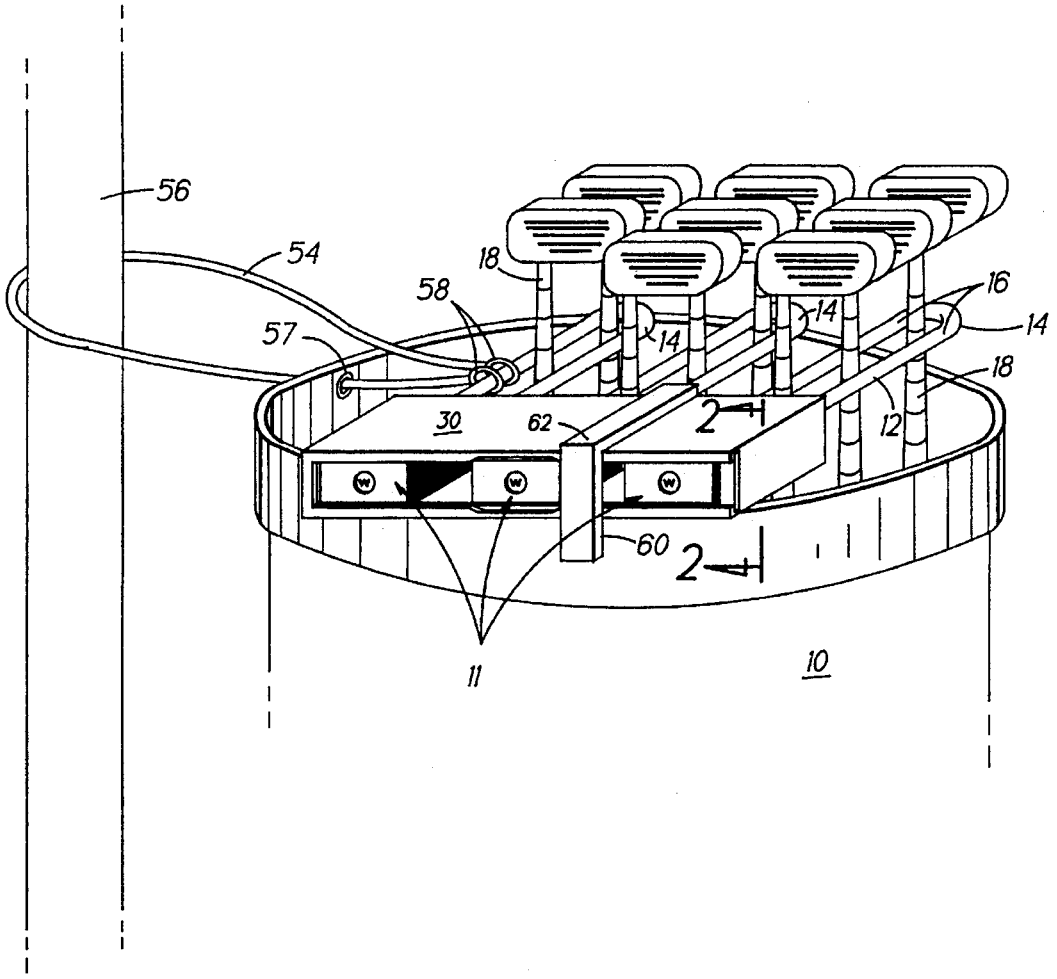
FIG. 1 is a perspective view of a golf club locking device of the type embodying the present invention shown securing a set of golf clubs and bag to a pole.

Referring to FIG. 1, the golf club locking device of the present invention is disposed atop a golf bag 10. The device includes a plurality of padlocks 11 which comprise U-shaped shackles 12, each of which comprise a bight portion 14 and two generally parallel legs or pins 16 which extend therefrom. The legs or pins 16 are spaced from each other at a distance wider than the neck of the golf club shafts 18, but narrower than the ends of the club, whereby each shackle 12 can straddle a plurality of golf club shafts 18. Preferably, the shackles are approximately 5–6 inches long to enable approximately five (5) golf club shafts 18 to be inserted therein and the legs are spaced approximately 7/16"–9/16" from one another.

Figure 4:
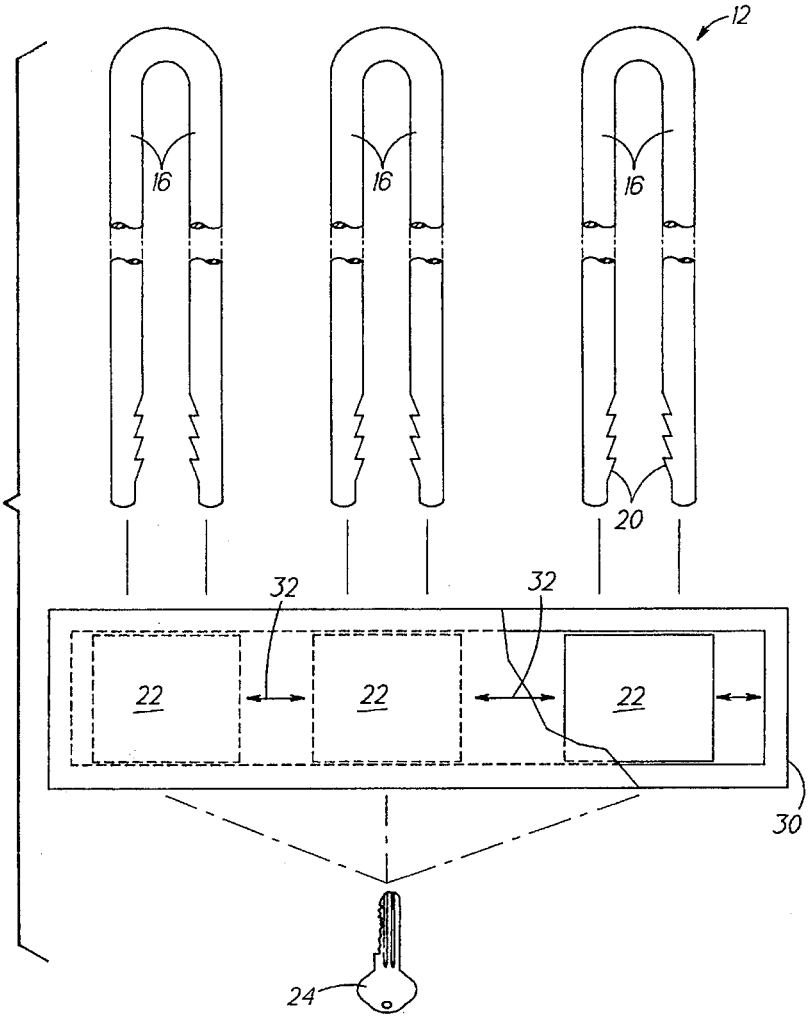
FIG. 4 is an exploded view with portions in phantom and portions broken away, of the locking device of FIG. 1.

As shown in FIG. 4, the legs 16 of each shackle have a series of serrations or flukes 20 disposed on the inside edges thereof which serve to permit the shackles 12 to be inserted and locked in a conventional manner to the shackle receivers 22. Each of the shackles 12 can be released from the receivers 22 using a key 24 and, in a preferred embodiment, each receiver is keyed alike to enable the user to operate the locking device using a single key. The padlock 11 is preferably fabricated from high strength hardened steel in order to resist being cut or broken.

Figure 3:
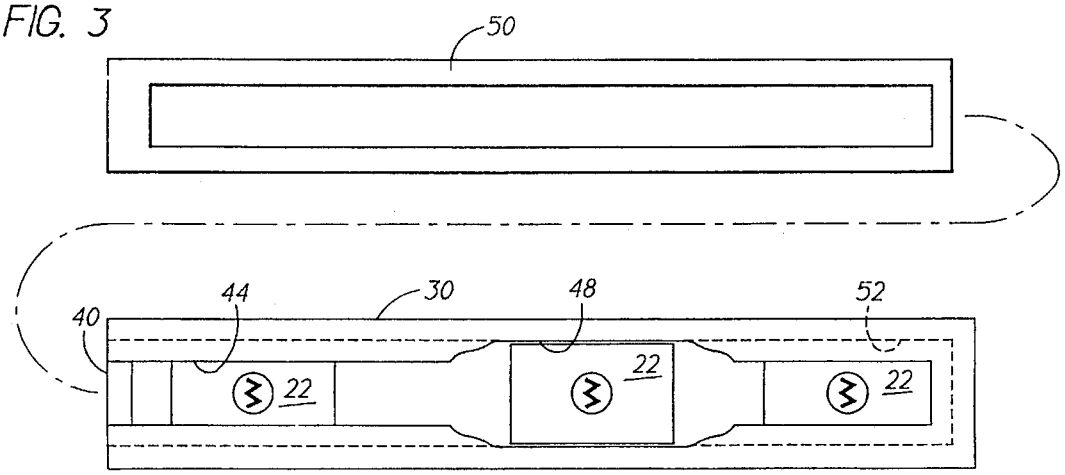
FIG. 3 is an exploded bottom view of the locking device of FIG. 1, with portions shown in phantom.
Figure 2:
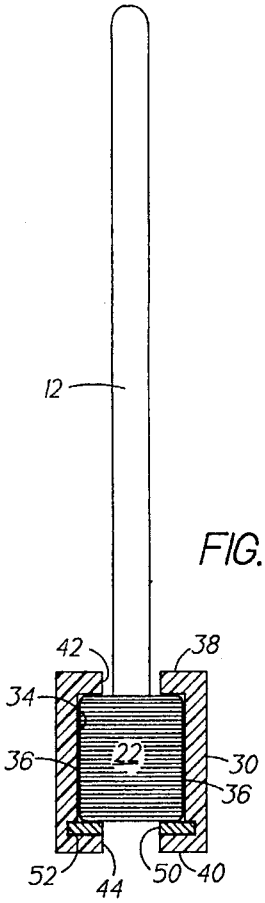
FIG. 2 is a cross-sectional view of the golf club lock taken along 2—2 of FIG. 1.

Referring still to FIG. 4 and as also shown in FIGS. 2 and 3, the receivers 22 are slidably disposed within an elongated retainer 30 which serves to secure them therein while permitting the receivers to slide laterally within the retainer as shown by arrows 32 in FIG. 4. This freedom of movement permits the padlocks to be aligned with the individual compartments of a given golf bag. In this manner, the locking device of the present invention is adaptable for use with virtually any golf bag. In the preferred embodiment, the length of the retainer 30 is approximately 6–8 inches.

As shown in FIG. 2, the retainer 30 has a generally rectangular cross-section with side walls 34 which slidably receive the side walls 36 of the receivers 22. Upper and lower walls 38 and 40 include longitudinally oriented recesses or slots 42 and 44 respectively, which serve to permit the shackles 12 and key 24 (not shown) to extend therethrough. Lower wall 40 further includes a channel or track 52 disposed longitudinally therein, for receiving retention plate 50 as will be discussed hereinafter.

As shown in FIG. 3, the retainer/receiver combination is assembled by inserting the receivers 22 into the retainer 30 through an enlarged portion 48 of the slot 44. Once the receivers have been inserted, the retention plate 50 (FIGS. 2 and 3) is inserted into the channel or track 52. When fully inserted, the plate 50 will effectively close the enlarged portion 48 of the slot 44 as shown in FIG. 1, thereby preventing removal of the receivers 22 from the retainer 30. A detent, snap-action device, or chemical bonding agent (not shown) will secure the plate 50 firmly in place within the track 52.

The retainer 30 is preferably fabricated from a polymer, composite or similarly rigid, lightweight material to keep the overall weight of the locking device to a minimum. Although the retainer may be fabricated from a high sheer strength material such as the steel used to fabricate the padlocks 11, use of such material is unnecessary since even if a would-be thief were to cut through the retainer, the individual padlocks 11 would still secure the clubs.

Figure 5:
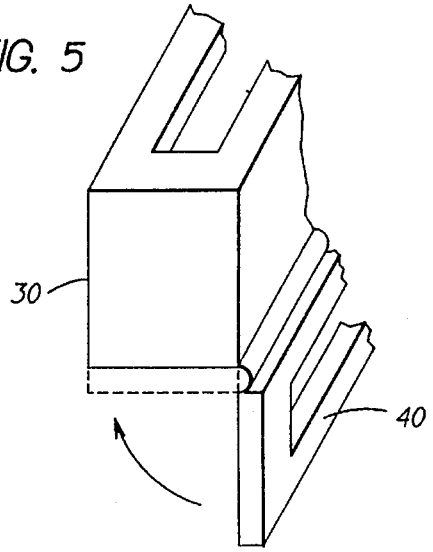
FIG. 5 is a perspective view of an alternate embodiment of a portion of the locking device of the present invention.
Figure 6:
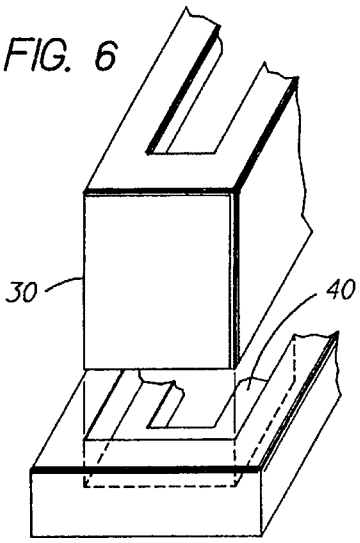
FIG. 6 is a view similar to that of FIG. 5 of a further embodiment of the locking device.

Referring now to FIGS. 5 and 6, in alternative embodiments, the bottom wall 40 may be hingedly disposed to the retainer 30, (FIG. 5) or may comprise a tray member (FIG. 6). In either case, the bottom walls 40 may include suitable fastening means such as snap-fit portions or detents, or may be chemically bonded onto the retainer 30 after insertion of the receivers 22 into the retainer 30.

As shown in FIG. 1, the preferred embodiment of the locking device of this invention further includes a cable 54 which can be used to secure the locking device and golf bag to a stationary object such as a fence or post 56, as will be discussed in greater detail hereinafter.

Figure 7:
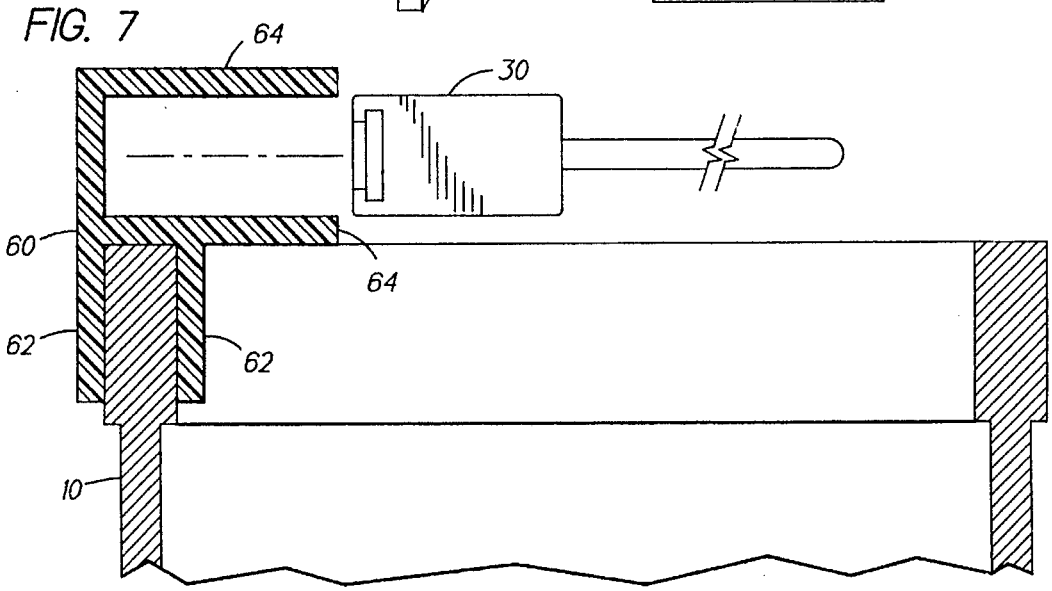
FIG. 7 is a partially exploded cross-sectional view of a further embodiment of the present invention disposed on a golf bag.

In a further embodiment of the present invention, as shown in FIG. 7, a clip 60 may be employed which has a pair of downwardly depending generally parallel legs 62 which may press-fittingly engage the upper edge of the golf bag 10. A pair of upper legs 64 similarly engage the retainer 30. The clip 60 therefore securely fastens the retainer to the golf bag to facilitate use of the locking device. In a still further embodiment, the retainer itself may be provided with depending legs 62 for engagement with the bag 10.

Figure 8:
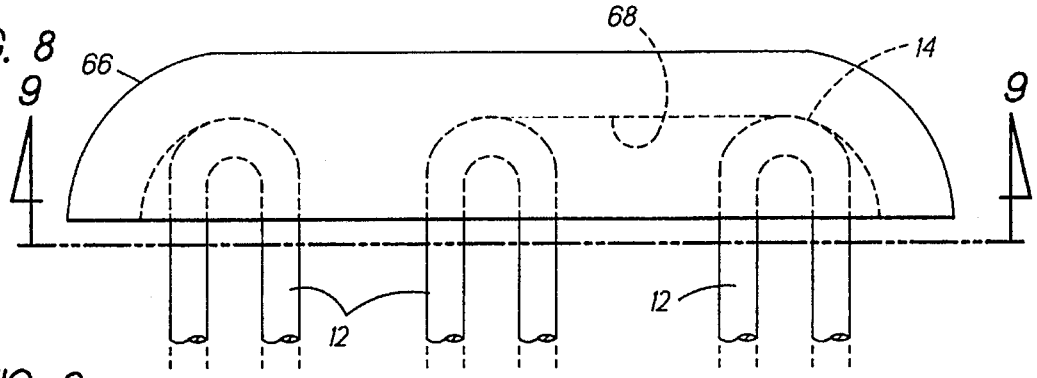
FIG. 8 is a plan view with portions in phantom of a further embodiment of the present invention.
Figure 9:
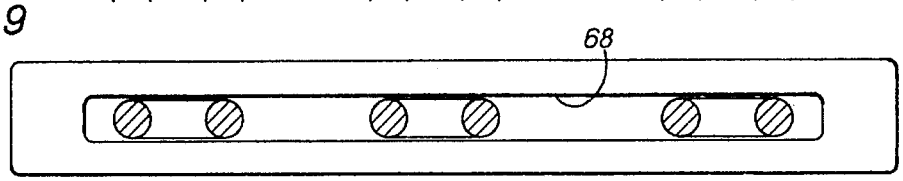
FIG. 9 is a cross-sectional view taken along 9—9 of FIG. 8.

As shown in FIGS. 8 and 9, a further embodiment includes a handle 66 having a cavity 68 disposed therein for press-fittingly receiving the bight portions 14 of the shackles 12. The handle thereby enables the user to easily manipulate all the shackles of the locking device simply by grasping the handle 66 during the operation thereof as will be discussed hereinafter.

In operation of the locking device of this invention, a user first slides each shackle 12 around the shafts 18 of several golf clubs. This action may be accomplished with each shackle individually, or simultaneously in the event a handle 66 is being utilized as discussed hereinabove. The shackles 12 are generally aligned with the compartments of a given golf bag 10 and preferably, each shackle is disposed to straddle all the clubs in a given compartment as shown in FIG. 1. At this point, the cable 54, having loops or eyes 58, may be looped around a stationary object such as a fence or post 56 through a ring, hole or grommet 57 disposed in the bag 10 and then the eyes 58 may be slipped over a leg 16 of one of the shackles, as shown in FIG. 1. Once the shackles are disposed around all of the shafts 18, each shackle is inserted into its respective receiver 22 to lock the clubs within the padlocks 11. Once all the shackles have been locked into their respective receivers, the device, including the retainer 30 and shackles 12, will rest on the upper edge of the golf bag 10 as shown in FIG. 1, and a clip 60 may be provided to secure the retainer onto the bag 10 as shown in FIG. 7.

Either with or without the clip 60, when the locking device of the present invention is so engaged, the golf clubs will be effectively secured to the post 56 and thereby protected from theft. Even if a would-be thief were to break or cut through the retainer 30, or in the event the user neglected to employ the cable 54, the clubs would still be engaged by each individual padlock 11. Although in this case, a thief may try to pick the locks, a top quality lock will make that task difficult and, as a result, the thief would have to damage the golf clubs to remove them.

Accordingly, the golf club locking device of the present invention offers the advantages of light weight and simple construction while it serves as an effective theft deterrent. The device is light enough to be easily carried within the golf bag by a user while playing golf and can then be deployed to protect the clubs while the user relaxes at the clubhouse. In addition, the device may be deployed without the cable 54 when traveling to prevent theft of individual clubs from the bag 10.

Although the golf club locking device of the present invention has been described herein as being generally disposed atop a golf bag, it should be recognized by one skilled in the art that the device could be incorporated into a wall, upper edge or other suitable portion of a golf bag as an integral part thereof, without departing from the spirit and scope of the invention.

The foregoing description is intended primarily for purposes of illustration. Although the invention has been shown and described with respect to an exemplary embodiment thereof, it should be understood by those skilled in the art that the foregoing and various other changes, omissions, and additions in the form and detail thereof may be made therein without departing from the spirit and scope of the invention.

Having thus described our invention, what is claimed is:

1. A locking device for releasably securing a plurality of golf clubs therein, each golf club having a head disposed at an end of the a shaft, the shaft having a narrow region near the head and a wider region further from the head, the device comprising:

a plurality of elongated shackles each having generally parallel limbs extending from a bight portion and being separated from one another;

plurality of receivers with the limbs of each shackle being lockingly receivable by a respective receiver to secure a plurality of clubs therein; and a unitary retainer for retaining said receivers therein wherein said receivers are disposed in slidably spaced relation within said retainer, whereby said receivers and said shackles, when lockingly received by a receiver, are alignable with individual compartments of a golf bag and whereby golf clubs received between the parallel limbs of a receiver cannot be removed from the receiver.

2. The locking device of claim 1, wherein said unitary retainer comprises a lightweight polymeric material.

3. The locking device of claim 1, wherein said retainer comprises an upper wall having a recess disposed therein through which said limbs extend for engagement with said receivers.

4. The locking device of claim 3, wherein said retainer comprises a lower wall having a recess disposed therein for enabling said limbs to be released from said receivers.

5. The locking device of claim 4, wherein said retainer further comprises means for selectively opening and closing said retainer whereby said receivers may be disposed and retained within said retainer.

6. The locking device of claim 5, wherein said recess disposed in said lower wall comprises an elongated slot having an enlarged portion through which said receivers may be inserted into said retainer and inwardly opening channels disposed on either edge of said slot for receiving a retention plate for selectively closing said enlarged portion.

7. The locking device of claim 1, further comprising a clip for retaining the device to a golf bag.

8. The locking device of claim 7, wherein said clip retains said retainer to the golf bag.

9. The locking device of claim 1, further comprising a cable for retaining the device to a stationary object.

10. The locking device of claim 1, further comprising a handle for receiving the bight portions of the shackles.

11. The locking device of claim 1, wherein said device is integrally disposed on the golf bag.

12. The locking device of claim 11, wherein said retainer is integrally disposed to an upper edge portion of the golf bag.

13. The locking device of claim 11, wherein said retainer is integrally disposed to a wall portion of the golf bag.

14. The locking device of claim 11, wherein said retainer is permanently disposed to the golf bag.

15. A locking device for releasably securing a plurality of golf clubs therein, each golf club having a head disposed at an end of the a shaft, the shaft having a narrow region near the head and a wider region further from the head, the device comprising:

a plurality of elongated shackles each having generally parallel limbs extending from a bight portion and being separated from one another;

a plurality of receivers with the limbs of each shackle being lockingly receivable by a respective receiver to secure a plurality of clubs therein; and a unitary retainer for retaining said receivers therein, said retainer comprising an upper wall having a recess disposed therein through which said limbs extend for engagement with said receivers and a lower wall having a recess disposed therein for enabling said limbs to be released from said receivers, said receivers being disposed in slidably spaced relation within the retainer whereby said receivers and said shackles, when lockingly received thereon, are alignable with individual compartments of a golf bag whereby golf clubs received between the parallel limbs of a receiver cannot be removed from the receiver.

16. The locking device of claim 15, wherein said retainer further comprises means for selectively opening and closing said retainer whereby said receivers may be disposed and retained within said retainer.

* * * * *